United States Patent [19]

Howard

[11] 3,984,002

[45] Oct. 5, 1976

[54] DRAPERY DISPLAY

[76] Inventor: Fred Howard, 500 Tenth Ave., New York, N.Y. 10018

[22] Filed: May 5, 1975

[21] Appl. No.: 574,420

[52] U.S. Cl. ..... 211/45; 16/87.2; 211/113; 211/123; 223/85; 223/87; 248/215; 248/360

[51] Int. Cl.[2] ..... A47F 7/16

[58] Field of Search ..... 211/45, 46, 47, 48, 211/113, 123, 124, 121, 122, 115, 116, 117, 118, 119; 24/84 C, 84 B; 223/85, 87; 160/330; 248/215, 251, 261, 359, 360; 16/87.2, 87.4 R, 87.4 W

[56] References Cited

UNITED STATES PATENTS

| | | | |
|---|---|---|---|
| 861,466 | 7/1907 | Jones | 211/46 |
| 1,509,657 | 9/1924 | Lachman | 211/123 |
| 2,540,023 | 1/1951 | Ackerman | 211/123 X |
| 2,846,079 | 8/1958 | Leeper | 211/123 |
| 2,868,389 | 1/1959 | Friend | 211/123 |
| 2,963,085 | 12/1960 | Schoos | 24/84 C |
| 3,019,911 | 2/1962 | Collette | 211/122 |
| 3,310,272 | 3/1967 | Brunger | 211/113 X |
| 3,481,483 | 12/1969 | Harvey et al. | 211/123 X |
| 3,568,852 | 3/1971 | Howard | 211/113 |
| 3,738,549 | 6/1973 | Driscoll | 223/85 |
| 3,896,931 | 7/1975 | Franklin | 223/85 X |

FOREIGN PATENTS OR APPLICATIONS

| | | | |
|---|---|---|---|
| 83,876 | 11/1957 | Denmark | 211/113 |
| 1,280,956 | 11/1961 | France | 211/113 |
| 1,478,610 | 3/1967 | France | 16/87.2 |
| 708,565 | 6/1941 | Germany | 211/46 |
| 446,634 | 3/1968 | Switzerland | 248/360 |
| 1,113,067 | 5/1968 | United Kingdom | 211/45 |

*Primary Examiner*—James T. McCall
*Assistant Examiner*—Thomas J. Holko
*Attorney, Agent, or Firm*—Cushman, Darby & Cushman

[57] ABSTRACT

Apparatus and manner for the display of pleated drapery samples and the like. A hanger specially adapted for supporting drapery samples by receiving the pleats thereof is provided. The hanger may be supported on a hanging rod having surface manifestations which provide for orientation of articles being displayed by the hangers at an angle of substantially less than 90° with respect to the direction of elongation of the rod.

9 Claims, 7 Drawing Figures

Fig. 3
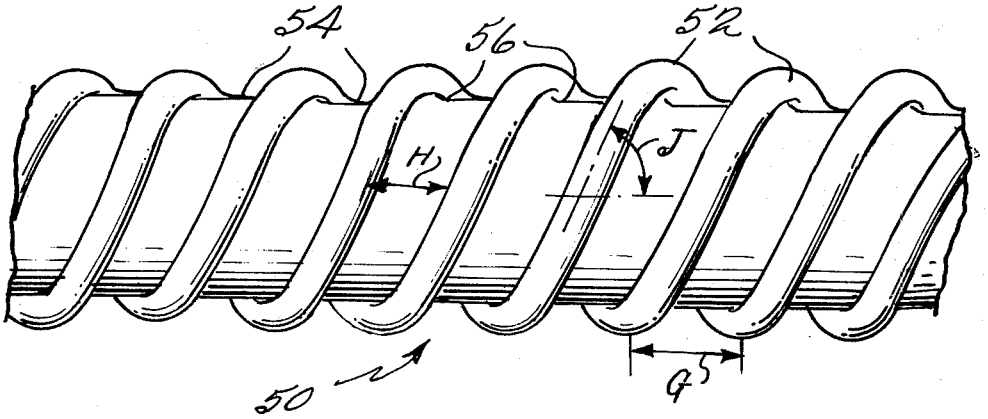
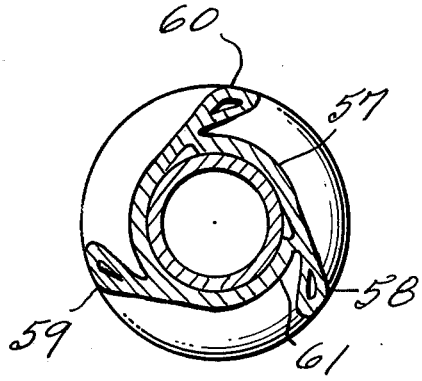
Fig. 4

DRAPERY DISPLAY

BACKGROUND AND SUMMARY OF THE INVENTION

The invention relates to the display of draperies and the like for inspection by viewers. Under conventional practice, the display of draperies normally consumes a large amount of space in order to display the draperies in the manner in which they will ultimately be used (free hanging). According to the present invention, draperies are displayed in a manner that allows ready inspection thereof in a free-hanging position which takes up a minimum amount of space, and allows ready replacement and movement of the draperies. This is accomplished by providing a hanger specially adapted for hanging pleated drapery samples (narrower than a full set of window panels used at present for display) and, additionally, by providing particular rod means for hanging the samples at an angle with respect to the rod means for providing ready discernment of the edges thereof with a large number displayed in a given area.

While hangers specially adapted for hanging various particular sample articles are known (see U.S. Pat. No. 3,568,852, for example), there are no hangers for hanging pleated drape samples in the manner in which they are to be hung on a conventional drapery rod or the like. According to the present invention, a hanger is provided having a body portion with a hook means extending upwardly from the top edge thereof, and cutouts formed in the body portion extending from the top edge thereof toward the middle thereof for receiving drapery pleats within the drape header. One cutout is disposed on each side of the hook means. In order to prevent interference of the header portion adjacent the hook means with the hook means, slits may be formed on either side of the hook means to allow the header to be woven past the hook means so that the whole portion of the header is disposed on one side of the hook means. Additionally, card mounting means may be provided on the hanger for providing identifying information about the draperies being displayed.

According to another aspect of the present invention, a rod means for supporting hangers is provided which orients hangers supported thereby at an angle of substantially less than 90° with respect to the direction of elongation of the rod means. This allows ready inspection of the edges of articles being displayed, and also provides for proper spacing thereof, both of which are especially importaht for proper display of drapery samples. The rod means has a number of upstanding portions formed thereon spaced a predetermined distance relative to the width of hanger hook portions for cooperation therewith. A plurality of helical upstanding portions wrapped around a central core may provide the particular rod means. While rod means having helical surfaces per se are known (see U.S. Pat. Nos. 1,509,657 and 2,846,079), such prior art rod means do not teach supporting articles displayed by hangers at an angle with respect to the direction of elongation of the rod means for providing more efficient display thereof.

It is the primary object of the present invention to provide improved means and manners for the display of articles such as pleated drapery samples and the like. This and other objects of the invention will become clear from an inspection of the detailed description of the drawings and from the appended claims.

BRIEF DESCRIPTION OF THE DRAWINGS

FIG. 3 is a plan view of an exemplary suporting rod according to the present invention for displaying fabric articles on hangers;

FIG. 4 is an end view of the rod shown in FIG. 3; and

DETAILED DESCRIPTION OF THE INVENTION

Figure 1A:
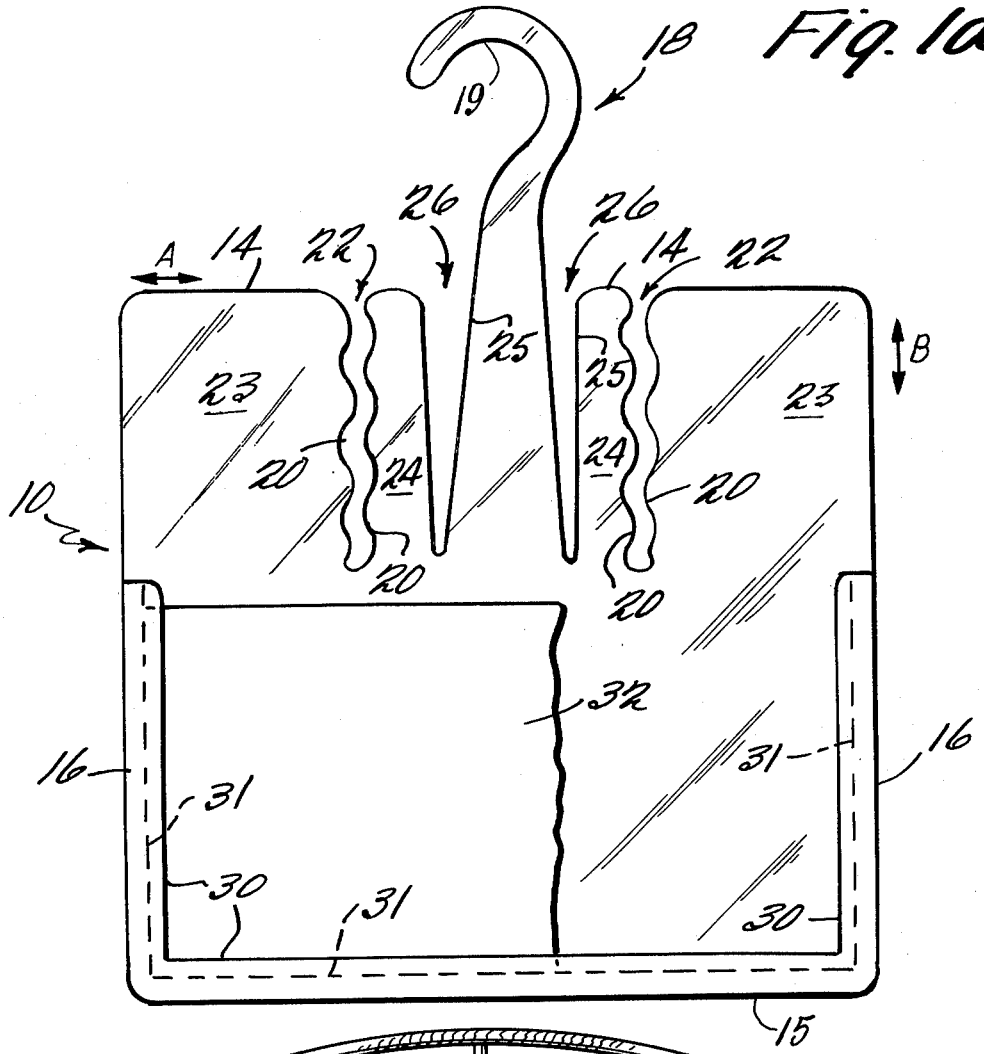
FIG. 1*a* is a plan view of an exemplary drapery sample display hanger according to the present invention.

An exemplary drapery sample display hanger according to the present invention is shown generally at 10 in FIG. 1*a*. The hanger 10 is specially adapted for hanging pleated drapery samples and the like. The hanger 10 includes a plate-like body portion 12 having a horizontal dimension A thereof, and a vertical dimension B thereof. The body portion 12 includes a top edge 14, a bottom edge 15, and side edges 16. Extending upwardly in dimension B past the top edge 14 is a hook means 18 having a surface 19 thereof adapted to engage a supporting rod or the like for supporting the hanger 10 as it hangs down in substantially a vertical plane. The hanger 10 may be injection moulded out of clear plastic, or may be formed by other suitable means and out of other suitable materials.

Edge means for defining drapery pleat receiving cutouts 22 or the like in the body member 12 are shown generally at 20 in FIG. 1*a*. As shown in the drawings, the edges 20 are wavy in configuration in order to provide for good holding contact of a drapery pleat or the like, however, they could take other forms. The cutouts 22 extend from the top edge 14 of the body 12 toward the middle portion thereof, and at least one cutout 22 is provided on each side of hook means 18.

Figure 1B:
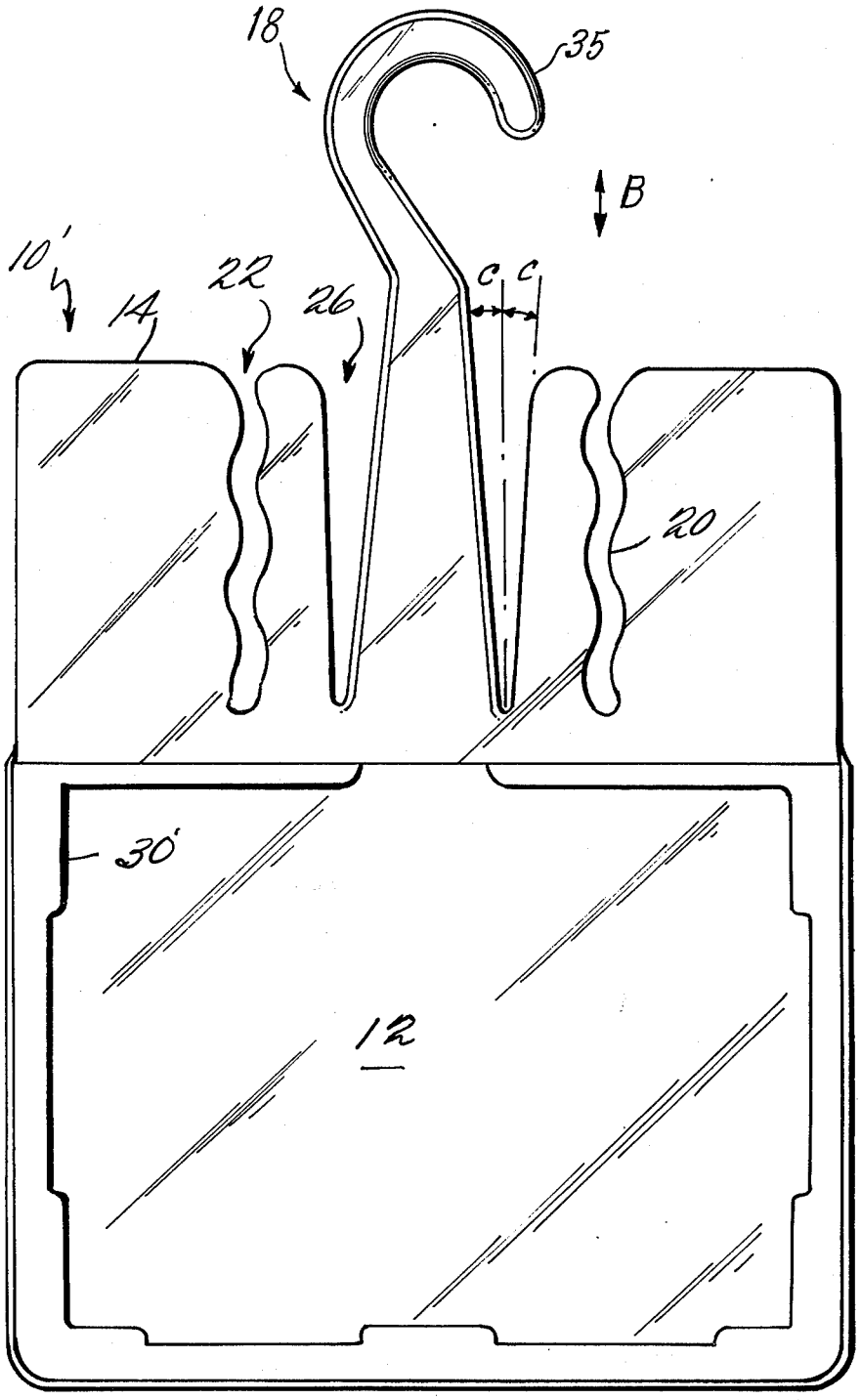
FIG. 1*b* is a plan view of a modification of the hanger shown in FIG. 1*a;*

A slit 26 is formed on either side of hook means 18 by slit defining edge means 25. The edges 25 may be arranged so that they are disposed at an angle C with respect to the dimension B (see FIG. 1*b* embodiment). Each slit 26 extends from the top edge 14 of the hanger body portion 12 toward the middle thereof. The slits 26 are for allowing a portion of a drapery header being supported by the hanger 10 to be disposed entirely on one side of the hook means 18 so that the hook means may support the drapery without the necessity of forming a slit in the drapery header for the hook means 18 to pass through. Slits 26 and cutouts 22 form finger portions 24 therebetween, and cutouts 22 and edges 16 form fingers 23.

Formed on the body portion 12 may be a plurality of rib means 30 having faces 31 thereof spaced from the body portion 12 to receive an information card 32 or the like therein. The information card 32 may provide all the necessary information for the drapery displayed by the hanger 10, and may be removable.

Figure 2:
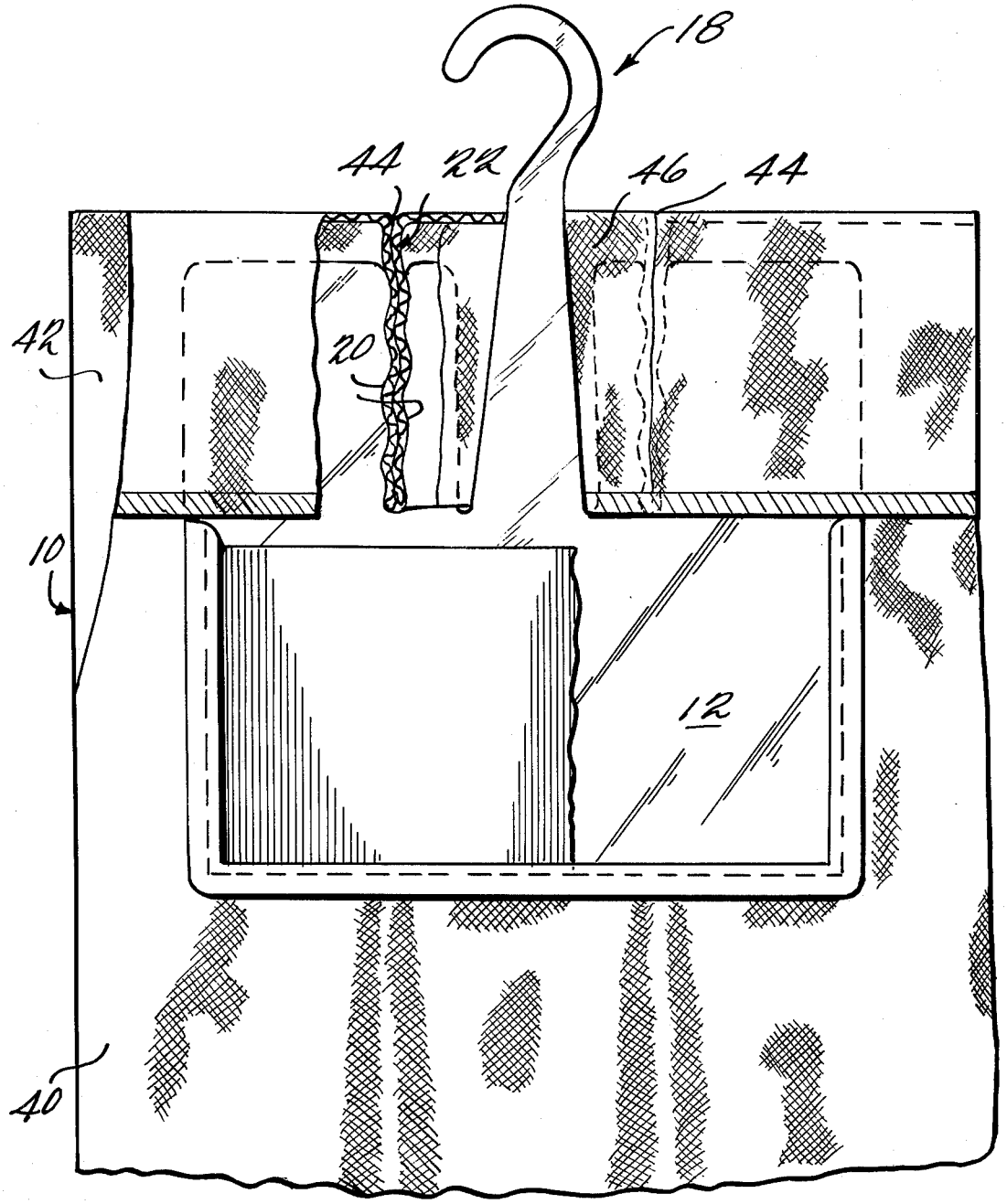
FIG. 2 is a plan view of the hanger of FIG. 1*a* supporting a drapery sample thereon with left-hand portions of the drapery sample cut away for clarity.

A drapery sample 40 or the like being displayed by a hanger 10 is shown in FIG. 2. The drapery sample 40 has a header 42 with pleats 44 formed therein, the header 42 having a middle portion 46 thereof adjacent the hook means 18. When a drapery sample 40 is to be displayed by a hanger 10, the header 42 of the drape 40 is placed over the top edge 14 of the body portion 12 with one flap of the header disposed on each side of plate 12 so that the portions 24 of the body 12 are confined within the interior of the header 42, and so that the cutouts 22 receive pleats 44 therewithin. The middle portion 46 of header 42 is passed through slits 26 and woven around hook means 18 so that the whole of middle portion 46 is disposed on one side of plate 12 adjacent hook means 18 instead of having one portion of header 42 disposed on each side of body 12 along the rest of top edge 14 thereof. When a drapery sample 40 or the like is thusly supported by a hanger 10, it will be seen that the drapery sample will hang freely in the manner in which a drape would in use, yet it is not necessary to mount the drapery on a conventional rod, or fold it over a conventional hanger. Thus, a large number of drapery samples may be clearly and prominently displayed for customer inspection in a small space, and price and style information therefor may be readily provided on a card 32 or the like connected directly with the hanger 10.

Figure 1C:
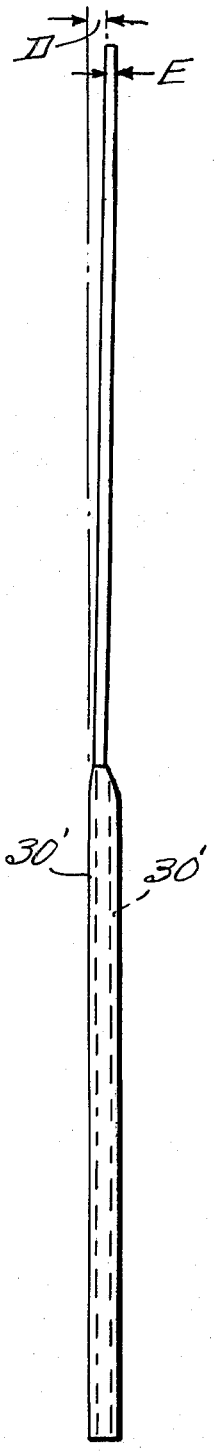
FIG. 1*c* is an edge view of the hanger shown in FIG. 1*b;*

According to the present invention, the hanger 10 may take different forms besides that illustrated and described with respect to FIG. 1*a*. One modification of a hanger according to the present invention is shown at 10' in FIG. 1*b*. The differences between the hanger 10' and the hanger 10 include a rib 35 formed on the hook means 18, and upstanding ribs 30' for display cards disposed on either side of plate portion 12 (see FIG. 1*c*) instead of merely one side thereof. The ribs 30' may receive folded over cards having printed information on one or both sides thereof. It is also noted that the hook means 18 and portions 23, 24 extending from body portion 12 may be tapered, having the plane thereof making an angle D with respect to the plane of the main body portion 12 having the ribs 30' attached thereto. The hook means 18 preferably have a predetermined width E to provide the surface 19 for engaging a supporting rod or the like.

A hanger supporting means according to the present invention is shown generally at 50 in FIG. 3. The hanger supporting means 50 is a rod means having exterior surface manifestations thereof which allow a hanger supported thereby to have the horizontal dimension A thereof disposed at an angle of substantially less than 90° (i.e. 45°) with respect to the direction of elongation F of the rod means 50. Such surface manifestations may include a plurality of upstanding portions 52 having the peaks thereof spaced apart a predetermined distance G along the length of the means 50. The areas 54 between the spaced upstanding portions 52 are for receipt of the hook means 18 of a hanger to be supported thereby. The portions 52 have side surfaces 56 thereof that are adapted to engage the sides of a hanger hook ortion 18 of predetermined width (E), and said side surfaces 56 are disposed at an angle J of substantially less than 90° with respect to the direction of elongation F of the rod means 50, and are spaced a distance H that is approximately the same as the width (E) of a hanger hook portion 18 to be supported thereby. Thus, when a hanger 10 is placed on the rod means 50, the horizontal dimension thereof is also disposed at an angle with respect to the direction of elongation F of the rod means 50, said angle being substantially the angle J.

One way of constructing a rod means 50 is by providing a central cylindrical member or core (57 — see FIG. 4) having formed therearound a plurality of helical members 58, 59, and 60 which may either be separate portions, or as shown in FIG. 4, part of an outer member 61 that is crimped to form the helical members 58, 59, and 60. Although three helical members 58, 59, and 60 are shown, it will be obvious to those of ordinary skill in the art that other numbers thereof may be provided.

Figure 5:
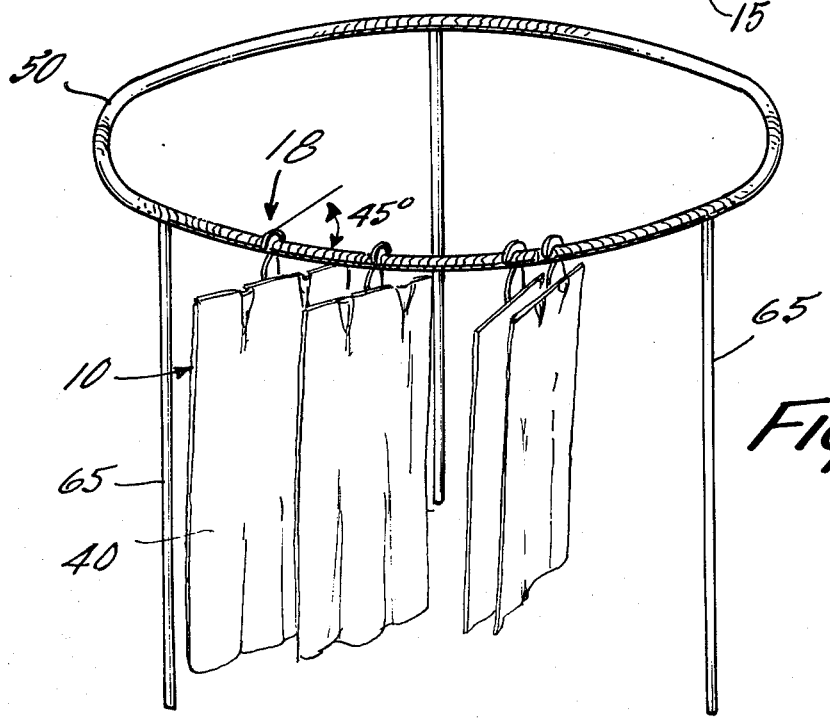
FIG. 5 is a perspective view of a rod as shown in FIG. 3 in circular form supporting a plurality of articles to be displayed on hangers thereon.

As shown in FIG. 5, a rod means 50 may be arranged in an arc or circle, supported a predetermined distance from the ground by supporting rods 65 or the like, and a plurality of drape samples 50 or the like supported by hangers 10 may hang downwardly from the rod means 50. Each drape sample 40 is generally disposed at an angle J with respect to the rod means 50, and in this way, a large number of drape samples can be disposed on the rod means while it is still easy for a viewer to see a side edge of each of the drape samples for ready inspection thereof. Uniform spacing of the drapery samples 40 or the like is also provided. Also, conventional hangers may be provided on means 50 and a plurality of hangers 10 hung from such conventional hangers.

It will thus be seen that according to the present invention, drapery samples may be easily displayed for proper viewing in a smaller amount of display area than is possible under present practice, which display samples may be readily moved and inspected by viewers.

Although the invention has been herein shown and described in what is presently conceived to be the most practical and preferred embodiments of the invention, it will be understood that many modifications may be made thereof within the scope of the invention, which scope is not to be limited except by the appended claims.

I claim:

1. A hanger assembly for display comprising a drapery sample having a pleated header, a hanger plate-like body portion having a top edge, bottom edge, two side edges, and two generally flat faces, a hook means for engaging a member for freely supporting said hanger, said hook means extending from said body portion outwardly past the top edge of said body portion and past the top edge of said drapery sample supported by said hanger, means defining a plurality of pleat receiving cutouts, extending from said top edge of said body portion toward the middle thereof, each cutout receiving a pleat of said drapery sample within it while portions of said header of said drapery sample supported by said hanger are disposed on each face of said body portion, one pleat receiving cutout being disposed on each side of said hook means, and means defining a slit on either side of said hook means in said body portion, adjacent said hook means, for allowing said header of said drapery sample being supported by said hanger to be disposed completely on one side of said hook means at said hook means.

2. A hanger as recited in claim 1 further comprising rib means supported by one of said body portion faces for receiving an information card therein.

3. A hanger as recited in claim 2 wherein rib means are formed on both said body portion faces.

4. A hanger as recited in claim 1 wherein said means for defining said pleat receiving cutouts provide a wavy border configuration for said cutouts for secure engagement of a pleat thereby.

5. A hanger as recited in claim 1 wherein said hanger is injection moulded of plastic.

6. The combination comprising a hanger for hanging an article to be displayed, said hanger having a hook portion of a predetermined width and a body portion, said body portion and said hook portion being disposed in a plane and said body portion having a generally horizontally extending elongated dimension, a hanger supporting elongated rod means for receiving said hook portion of said hanger on an exterior surface thereof for supporting said hanger thereon, said rod means having a direction of elongation and including means defining an exterior surface thereof having a plurality of upstanding portions with side surfaces spaced a predetermined distance from each other, said side surfaces being disposed at an angle of substantially less than 90° with respect to the direction of elongation of said rod means, said predetermined distance from one side surface of an upstanding portion to another side surface of an adjacent upstanding portion being of substantially the same magnitude as said predetermined width of said hanger hook portion so that said generally horizontal elongated dimension of said hanger will be disposed at an angle of substantially less than 90° with respect to said direction of elongation of said rod means when supported by said rod means, said angle being substantially the same as the angle between said upstanding portion side surfaces and the direction of elongation of said rod means, and a drapery sample of the like having a pleated header, said drapery sample or the like supported by said hanger, and wherein said hanger body portion is plate-like having a top edge, bottom edge, two side edges, and two generally flat faces, and wherein said hook portion extends outwardly past the top edge of said body portion, and wherein said hanger further comprises means defining a plurality of pleat receiving cutouts extending from said top edge of said body portion toward the middle thereof for receiving a pleat within each cutout while portions of said header of said drapery sample or the like are disposed on either side face of said body portion, one pleat receiving cutout being disposed on each side of said hook portion, and means defining a slit in said body portion on either side of said hook portion for allowing said header of said drapery sample or the like to be disposed completely on one side of said hook portion at said hook portion.

7. A combination as recited in claim 6 wherein said rod means comprises a generally cylindrical core having a helical member wrapped around the exterior surface thereof for providing said upstanding portions of the exterior surface of said rod means.

8. A combination as recited in claim 7 wherein said rod means further includes a plurality of helical members wrapped around the exterior surface of said core for providing said upstanding portions of the exterior surface of said rod means.

9. A combination as recited in claim 7 wherein said rod means extends arcuately in its direction of elongation.

* * * * *